US009310159B1

(12) United States Patent
Lemoine

(10) Patent No.: US 9,310,159 B1
(45) Date of Patent: Apr. 12, 2016

(54) FIREARM WITH SHOTGUN RECEIVER AND STABILIZING BRACE ADAPTOR

(71) Applicant: Eric Lemoine, Winter Garden, FL (US)

(72) Inventor: Eric Lemoine, Winter Garden, FL (US)

( * ) Notice: Subject to any disclaimer, the term of this patent is extended or adjusted under 35 U.S.C. 154(b) by 1 day.

(21) Appl. No.: 14/724,331

(22) Filed: May 28, 2015

Related U.S. Application Data

(60) Provisional application No. 62/085,004, filed on Nov. 26, 2014.

(51) Int. Cl.

| | |
|---|---|
| ***F41A 15/00*** | (2006.01) |
| ***F41C 7/02*** | (2006.01) |
| ***F41C 23/00*** | (2006.01) |
| ***F41C 23/20*** | (2006.01) |

(52) U.S. Cl.
CPC . *F41C 7/02* (2013.01); *F41C 23/00* (2013.01); *F41C 23/20* (2013.01)

(58) Field of Classification Search
CPC ..... F41C 23/00; F41C 33/003; F41C 23/14; F41C 23/12
USPC ..... 42/25
See application file for complete search history.

(56) References Cited

U.S. PATENT DOCUMENTS

| | | | | |
|---|---|---|---|---|
| 5,771,620 | A * | 6/1998 | Crawford | F41A 9/41 42/19 |
| 5,827,992 | A * | 10/1998 | Harris | F41A 19/14 42/97 |
| 6,374,528 | B1 * | 4/2002 | Davis | F41C 23/00 42/71.01 |
| 7,984,580 | B1 * | 7/2011 | Giauque | F41C 23/06 42/73 |
| 8,756,846 | B1 | 6/2014 | Lemoine | |
| 8,869,444 | B2 | 10/2014 | Bosco | |
| 2003/0140542 | A1 * | 7/2003 | Kay | F41C 23/20 42/75.03 |
| 2014/0137453 | A1 * | 5/2014 | Lamb | F41A 9/01 42/6 |

OTHER PUBLICATIONS

"Mil Spec vs. Commercial Spec Buffer Tubes." AR15 for Noobs RSS. Ed. Admin Chris. May 10, 2010. Web. Aug. 25, 2015. <https://web.archive.org/web/20141121124358/http://www.ar15fornoobs.com/mil-spec-vs-commercial-spec-buffer-tubes>.*

Letter from U.S. Department of Justice to Mr. Eric Lemoine dated Oct. 28, 2014, 3 pages.

* cited by examiner

*Primary Examiner* — Samir Abdosh
(74) *Attorney, Agent, or Firm* — Jason T. Daniel, Esq.; Daniel Law Offices, P.A.

(57) ABSTRACT

A firearm with shotgun receiver and stabilizing brace adaptor includes a shotgun receiver assembly that is in communication with a box-style shotgun shell magazine, a shotgun barrel, a tubular magazine, a pump handle, a trigger assembly, a hand grip, and a stabilizing brace adaptor. The stabilizing brace adaptor includes an elongated tubular member having a threaded end, and a grip connector that is interposed between the tubular member and the hand grip.

8 Claims, 3 Drawing Sheets

FIREARM WITH SHOTGUN RECEIVER AND STABILIZING BRACE ADAPTOR

CROSS-REFERENCE TO RELATED APPLICATIONS

This application claims the benefit of U.S. Application Ser. No. 62/085,004 filed on Nov. 26, 2014, the contents of which are incorporated herein by reference.

TECHNICAL FIELD

The present invention relates generally to firearms, more particularly to a firearm having an adaptor for receiving a stabilizing brace.

BACKGROUND

The statements in this section merely provide background information related to the present disclosure and may not constitute prior art.

The accuracy and proficiency of firing a weapon is greatly influenced by the user's ability to securely grip the weapon in a steady position while firing. This is especially true with respect to weapons such as handguns, for example, wherein the weight of the weapon is concentrated forward from the pistol-grip, and where there is no shoulder stock or other means of securing the weapon to the users body while firing. However, if the individual utilizing the weapon has a physical disability that prevents them from being able to firmly grip the handgun or steady the handgun for any appreciable length of time, it can be nearly impossible for them to accurately aim and fire the weapon.

As a result, there are known stabilizing braces which can attach to pistols. Each of these devices typically includes a main body having a strap or other such member that can physically secure the pistol to a user's forearm. One such example is described in U.S. Pat. No. 8,869,444, to Bosco, the contents of which are incorporated herein by reference. Another known forearm grip includes the SB 15 pistol stabilizing brace that is commercially available from SIG SAUER.

Owing to the shape, weight, size and recoil involved, such items have heretofore been designed and constructed to mate exclusively with small caliber weapons such as handguns and small riffles, for example. As such, disabled individuals have not been able to enjoy many of the recent advances in shotgun technology, such as the introduction of shotgun magazine receivers which can accommodate and fire box-style removable magazines in a manner that greatly reduces the recoil of the weapon while firing.

Accordingly, it would be beneficial to provide a Firearm with a Shotgun Receiver assembly and an adaptor for receiving a Stabilizing Brace, so as to allow a disabled and/or physically challenged individual to accurately fire a pistol-gripped shotgun.

SUMMARY OF THE INVENTION

The present invention is directed to a firearm with shotgun receiver and stabilizing brace adaptor. One embodiment of the present invention can include a shotgun receiver assembly that is in communication with a box-style shotgun shell magazine, a shotgun barrel, a tubular magazine, a pump handle, a trigger assembly, a hand grip, and a stabilizing brace adaptor. The receiver assembly can function to receive and fire shotgun shells from the box-style magazine, and the brace adaptor can extend from the rear portion of the hand grip.

In another embodiment, the stabilizing brace adaptor can include a grip connector that is physically secured onto the hand grip, and a brace engagement member that is defined by an elongated tubular member that is removably secured onto the grip connector. The brace engagement member including a shape and dimension that is suitable for engaging the central opening/passage of a commercially available stabilizing brace.

Yet another embodiment of the present invention can include a firearm having a barrel that is approximately 9 inches in length, and an overall length of 27 inches.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
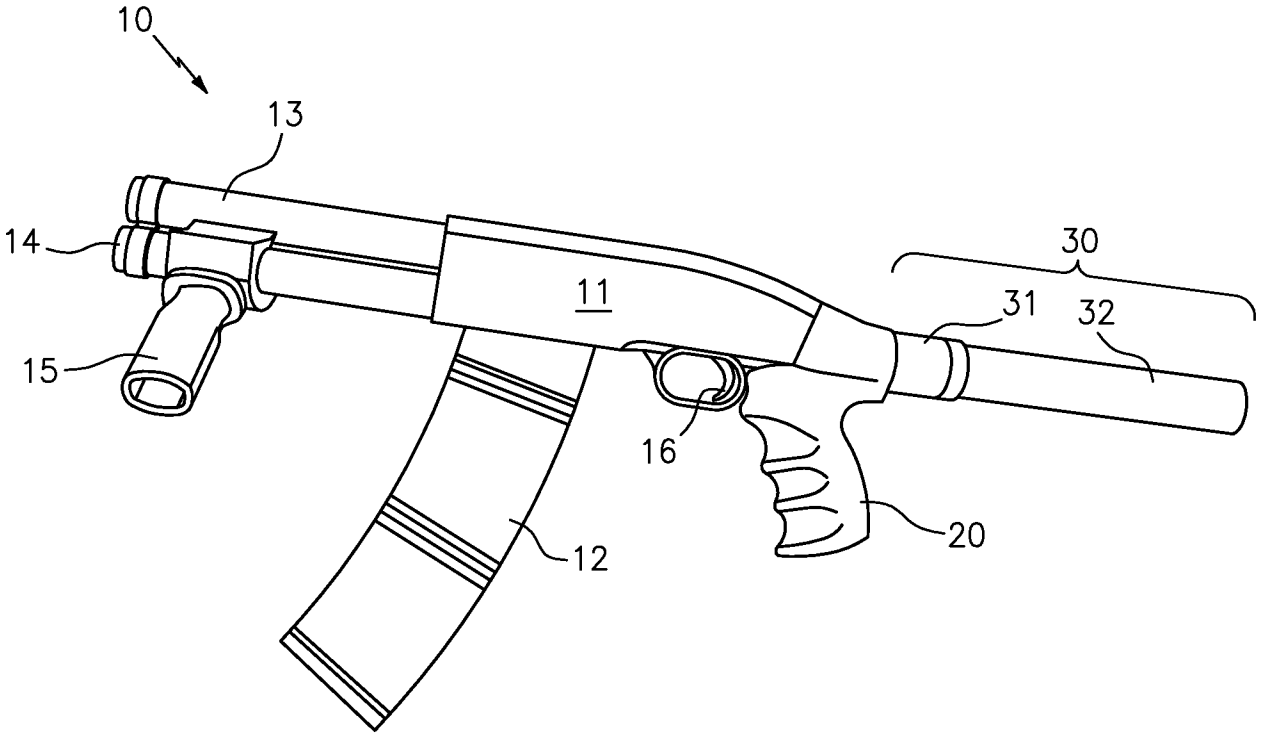
FIG. 1 is a perspective view of the firearm with shotgun receiver and stabilizing brace adaptor, that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Figure 2:
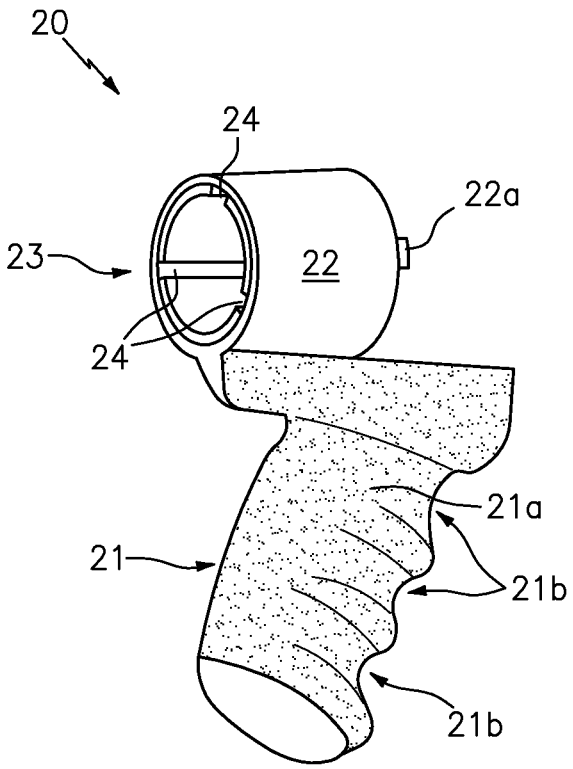
FIG. 2 is a perspective view of the hand grip of the firearm, in accordance with one embodiment of the invention.
Figure 3:
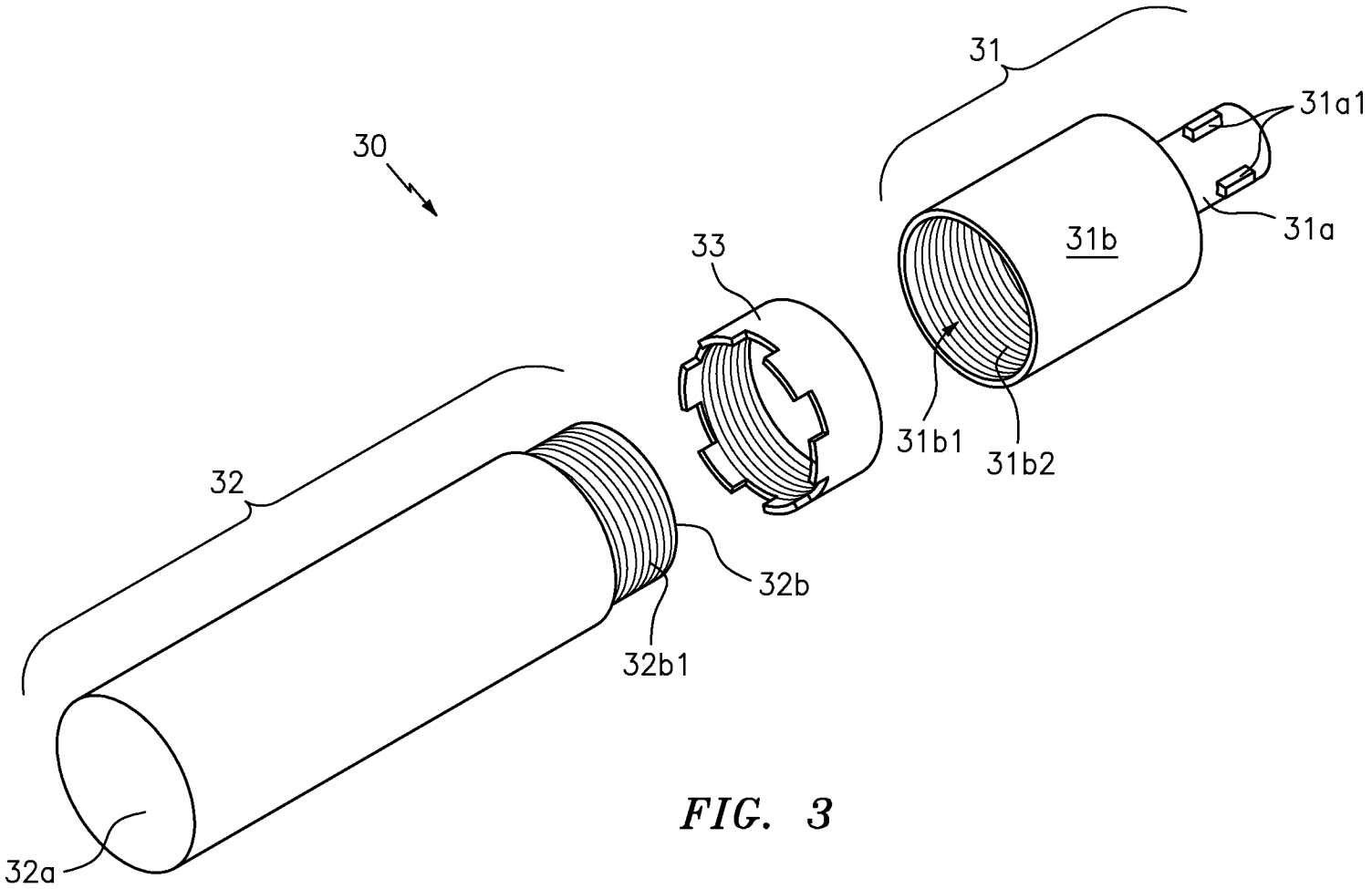
FIG. 3 is an exploded parts view of the stabilizing brace adaptor, of the firearm, in accordance with another embodiment of the invention.

FIGS. 1-3 illustrate one embodiment of a firearm with shotgun receiver and stabilizing brace adaptor, that is useful for understanding the inventive concepts disclosed herein. As shown, the firearm 10 can include, essentially, a shotgun receiver assembly 11, that is in communication with, a removable box-style magazine 12, a shotgun barrel 13, a tubular magazine 14, a pump handle 15, a trigger assembly 16, a hand grip 20, and a stabilizing brace adaptor 30.

In the preferred embodiment, the receiver assembly 11 will comprise the applicant's patented Pump Action Shotgun Receiver Assembly, that is described in U.S. Pat. No. 8,756, 846, the contents of which are incorporated herein by reference. This assembly functions to receive and fire shotgun shells from a box-style removable magazine in a manner that produces extremely little recoil, thereby reducing the difficulty in handling the weapon, and greatly increasing the accuracy of the same. Of course, the invention is not to be construed as limiting to the above, as any number of other receiver assemblies are also contemplated.

As shown in FIG. 2, the device can preferably include a pistol-style hand grip 20. As shown, the grip can include a lower handle section 21 having a rough high-grip surface area 21*a* and a plurality of finger ridges 21*b* located thereon. A mating collar 22 is disposed along the upper end of the handle section and functions to engage the receiver assembly along a first side 22*a*. As shown, the rear facing side of the mating collar includes a central aperture 23 having one or more recessed channels 24 disposed therein.

As described herein, the grip 20 can be constructed from any number of strong, impact resistant materials such as metal, plastic, wood or composite materials, for example, that are capable of withstanding the rigors of weapon usage.

FIG. 3 is an exploded parts view of the stabilizing brace adaptor 30. As shown, the adaptor can include a grip connector 31, a brace engagement member 32, and an optional locking ring 33.

The grip connector 31 can include a first end that is defined by a protrusion 31*a* having one or more outward radiating channels 31*a*1 disposed thereon. The protrusion and channel(s) including a shape and dimension that are complementary to that of the above described aperture 23 and recessed channel(s) 24. In this regard, the protrusion 31*a* can be inserted within the aperture and secured therein via a bolt or other such hardware (not illustrated). Of course, this is but one of many possible ways to secure the grip connector to the grip.

The second end of the grip connector can include a generally circular member 31*b* having a central aperture 31*b*1 with a plurality of threaded elements 31*b*2 disposed therein.

The brace engagement member 32 can include an elongated, generally tubular member having a first end 32*a*, and a second end 32*b* with a plurality of threaded elements 32*b*1 disposed along an outside portion thereof. In the preferred embodiment, the engagement member can be constructed from a hollow piece of aluminum tubing having a length of approximately 5⅞ inches, and a diameter of approximately 1.2 inches. Such a dimension being suitable for allowing the first end 32*a* to be positioned within the central opening/passage of most commercially available stabilizing braces, including those described herein above.

As should be apparent, the second end of the engagement member 32*b* can be secured within the aperture 31*b*1 and maintained in place via a locking ring, such as the illustrated castle nut 33, for example. In this regard, the threaded elements 31*b*2 and 32*b*1 can act to securely connect the adaptor onto the above described pistol grip in a secure and non-permanent manner. Threaded elements having lands and grooves for securing complementary objects together via a twisting motion are extremely well known. Accordingly, no further description will be provided. Although described above as utilizing threaded elements capable of creating a secure attachment point between two objects when a rotational force is applied thereto, this is for illustrative purposes only, as any number of known connectors and components capable of creating a removable seal between two items can also be utilized.

As described herein, the firearm with shotgun receiver and stabilizing brace adaptor 10 is designed to be utilized by disabled and/or physically challenged individuals. As such, it is preferred that firearm include a length that is as short and lightweight as possible so as to allow for easy handling when used in conjunction with a stabilizing forearm brace.

As such, in one preferred embodiment the barrel can include a length of 9 inches, and the length of the entire firearm 10 can be 27 inches (e.g., measured from the end of the barrel 13 to the first end of the brace engagement member 32*a*). When utilized properly with a suitable stabilizing brace, the resulting weapon is advantageously classified by the Bureau of Alcohol, Tobacco, Firearms and Explosives as a fully legal "firearm" under the Gun Control Act (GCA) of 1968.

Accordingly, the above described firearm with shotgun receiver and stabilizing brace adaptor 10 can function to allow disabled individuals with brace adaptors to accurately fire shotgun shells from a box-style removable magazine in a novel manner.

As described herein, one or more elements of the firearm 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the grip connector 31, and the brace engagement member 32, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A firearm, comprising:

a shotgun receiver assembly;

a box-style shotgun shell magazine that is removably secured to the receiver assembly;

a shotgun barrel that is in communication with the receiver assembly;

a tubular magazine that is in communication with the receiver assembly;

a pump handle that is in communication with the tubular magazine;

a trigger assembly that is in communication with the receiver assembly;

a hand grip that is in communication with the receiver assembly; and a stabilizing brace adaptor that is in communication with the hand grip, said adaptor functioning to receive a stabilizing brace, wherein the shotgun receiver assembly comprises:

an elongated receiver body having a front end, a back end, a top surface, a bottom surface, and a pair of opposing side surfaces defining an interior space, each of the opposing side surfaces including an elongated channel disposed along an inside portion thereof, and arranged in a generally parallel orientation to each other;

a magazine opening disposed along the bottom side of the receiver body at a location adjacent to the front end of the receiver body, said magazine opening being in communication with the box-style shotgun shell magazine;

a bolt having a font end, a rear end, a top surface, a bottom surface and a pair of side walls defining a firing pin chamber;

a firing pin disposed within the chamber;

a lock stop opening extending from the top surface of the bolt to the bottom surface of the bolt;

an extractor arm recess located along each side wall of the bolt and adjacent to the front wall; and a spring groove disposed along one of the side walls of the bolt.

2. The firearm of claim 1, wherein the hand grip further comprises:

a pistol-style grip having a lower handle section with a plurality of finger ridges located thereon.

3. The firearm of claim 2, further comprising:

a mating collar that is disposed along an upper end of the handle section, said mating collar including a first end for engaging the receiver assembly, and a second end for engaging the stabilizing brace adaptor.

4. The firearm of claim 3, further comprising:

a central aperture having one or more recessed channels that are disposed along the second end of the mating collar.

5. The firearm of claim 4, wherein the stabilizing brace adaptor comprises:

a grip connector that includes a first end that is defined by a protrusion and one or more outward radiating channels disposed thereon, each of said protrusion and one or more outward radiating channels functioning to engage the central aperture and one or more recessed channels of the mating collar, respectively, and a second end that is defined by a generally circular member having a threaded central aperture therein.

6. The firearm of claim 5, wherein the stabilizing brace adaptor further comprises:

a brace engagement member that includes an elongated tubular member having a first end a second end, and a plurality of threaded elements disposed along an outside surface of the second end, wherein the second end of the brace engagement member is removably secured to the threaded aperture of the grip connector via the plurality of threaded elements.

7. The firearm of claim 6, wherein the brace engagement member is constructed from a hollow piece of aluminum tubing having a length of approximately 5⅞ inches, and a diameter of approximately 1.2 inches.

8. The firearm of claim 6, wherein the stabilizing brace adaptor further comprises:

a locking ring that is interposed between the brace engagement member and the grip connector.

* * * * *